US010763614B2

(12) United States Patent
Kanda et al.

(10) Patent No.: US 10,763,614 B2
(45) Date of Patent: Sep. 1, 2020

(54) CONNECTOR HAVING AN ENGAGED PART CONTACTING AN ENGAGEMENT PROJECTION AFTER A TIP END PROJECTION OF THE ENGAGED PART FACES THE ENGAGEMENT PROJECTION

(71) Applicant: Yazaki Corporation, Tokyo (JP)

(72) Inventors: Hidenori Kanda, Shizuoka (JP); Kazuto Ohtaka, Shizuoka (JP); Daiki Amemiya, Tokyo (JP); Sho Kawano, Tokyo (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/525,490

(22) Filed: Jul. 29, 2019

(65) Prior Publication Data

US 2020/0044388 A1 Feb. 6, 2020

(30) Foreign Application Priority Data

Aug. 1, 2018 (JP) ..... 2018-145166

(51) Int. Cl.
*H01R 13/631* (2006.01)
*H01R 13/627* (2006.01)
*H01R 13/426* (2006.01)

(52) U.S. Cl.
CPC ..... *H01R 13/6271* (2013.01); *H01R 13/426* (2013.01); *H01R 13/631* (2013.01)

(58) Field of Classification Search
CPC . H01R 13/426; H01R 13/631; H01R 13/6271
USPC ..... 439/350
See application file for complete search history.

(56) References Cited

U.S. PATENT DOCUMENTS 4,867,699 A * 9/1989 Oda ..... H01R 13/64 439/355
4,971,580 A * 11/1990 Ward ..... H01R 13/4367 264/272.13
5,192,225 A * 3/1993 Suzuki ..... H01R 13/6272 439/350
5,330,369 A * 7/1994 Nozaki ..... H01R 13/641 439/350

(Continued)

FOREIGN PATENT DOCUMENTS

DE 10 2018 212 911 A1 2/2019
WO 2008/069866 A2 6/2008

(Continued)

*Primary Examiner* — Abdullah A Riyami
*Assistant Examiner* — Vladimir Imas
(74) *Attorney, Agent, or Firm* — Kenealy Vaidya LLP

(57) ABSTRACT

In the connector, a female beak of a female housing includes a climbing surface formed on an end part at a removing direction side, and a tip end projection that protrudes in a removing direction from an end part at an upper direction side of the climbing surface. A male beak of a male housing includes a climbed surface formed on an end part at an inserting direction side, and that comes into contact with the climbing surface in a fitting direction. After connection of a male terminal housed in the male housing with a female terminal housed in the female housing is started, a tip end projection faces the male beak in a vertical direction. After the tip end projection faces the male beak, the climbing surface comes into contact with the climbed surface.

14 Claims, 9 Drawing Sheets

(56) References Cited

U.S. PATENT DOCUMENTS 5,380,217 A * 1/1995 Yagi ..... H01R 13/6272 439/350
5,692,923 A * 12/1997 Sawada ..... H01R 13/6272 439/350
5,775,957 A * 7/1998 Fink ..... H01R 13/4361 439/595
5,839,915 A * 11/1998 Ford ..... H01R 13/641 439/489
5,865,636 A * 2/1999 Myer ..... H01R 13/5221 439/275
5,928,038 A * 7/1999 Berg ..... H01R 13/6272 439/489
5,954,546 A * 9/1999 Fink ..... H01R 13/4361 439/595
6,004,153 A * 12/1999 Myer ..... H01R 13/641 439/352
6,068,507 A * 5/2000 Popa ..... H01R 13/641 439/489
6,077,101 A * 6/2000 Garretson ..... H01R 13/627 439/352
6,095,844 A * 8/2000 Kasai ..... H01R 13/6271 439/350
6,290,539 B1 * 9/2001 Wilber ..... H01R 13/4223 439/595
6,659,789 B2 * 12/2003 Nagamine ..... H01R 13/639 439/352
6,716,052 B2 * 4/2004 Kane ..... H01R 13/641 439/352
6,780,045 B2 * 8/2004 Shuey ..... H01R 13/6272 439/352
6,817,884 B1 * 11/2004 Chen ..... H01R 13/642 439/350
6,857,892 B2 * 2/2005 McLauchlan ..... H01R 13/6272 439/352
6,896,538 B2 * 5/2005 Grubbs ..... H01R 13/52 439/352
6,913,494 B2 * 7/2005 Ward ..... H01R 13/4365 439/352
7,037,130 B2 * 5/2006 Dillon ..... H01R 13/6275 439/357
7,326,074 B1 2/2008 Lim et al.
7,387,545 B2 * 6/2008 Tyler ..... H01R 13/4365 439/595
7,404,731 B2 * 7/2008 Lim ..... H01R 13/641 439/358
7,559,787 B2 * 7/2009 Shigeta ..... H01R 13/6272 439/358
7,682,181 B1 * 3/2010 Jones, Jr. ..... H01R 13/6272 439/352
8,016,606 B1 * 9/2011 Kwan ..... H01R 13/641 439/352
8,100,708 B2 * 1/2012 Kataoka ..... H01R 13/03 439/271
8,226,429 B2 * 7/2012 Umetsu ..... H01R 13/631 439/262
8,628,344 B2 * 1/2014 Cole ..... H01R 13/6272 439/352
8,678,846 B2 * 3/2014 Hitchcock ..... H01R 13/6272 439/352
9,762,002 B1 * 9/2017 Matsumoto ..... H01R 13/6271
2019/0044278 A1 2/2019 Amemiya et al.

FOREIGN PATENT DOCUMENTS

WO 2010/032088 A1 3/2010
WO 2013/092310 A1 6/2013

* cited by examiner

CONNECTOR HAVING AN ENGAGED PART CONTACTING AN ENGAGEMENT PROJECTION AFTER A TIP END PROJECTION OF THE ENGAGED PART FACES THE ENGAGEMENT PROJECTION

CROSS-REFERENCE TO RELATED APPLICATION(S)

The present application claims priority to and incorporates by reference the entire contents of Japanese Patent Application No. 2018-145166 filed in Japan on Aug. 1, 2018.

BACKGROUND OF THE INVENTION

1. Field of the Invention

The present invention relates to a connector.

2. Description of the Related Art

For example, as a conventional connector applied to a wire harness and the like, International Publication WO 2010/032088 discloses a connector position assurance (CPA) connector provided with a male connector, a female connector, and a CPA member serving as a fitting detection member that is slidably fixed to the outside of the female connector. In the CPA connector, when a male housing is inserted into a female housing, a engaged part of the female housing enters between an engagement projection part and a separated projection part of the male housing, and the engaged part is brought into an engaged state. Consequently, the male connector is fitted to the female connector. Moreover, in the engaged state, by moving the CPA member that is supported by the female housing from the initial position to the fitting detection position, the detection projection part of the CPA member sequentially climbs over the engagement projection part and the engaged part.

When the male housing is inserted into the female housing, a female terminal housed in the female housing and a male terminal housed in the male housing are connected. Consequently, when the male housing is fitted to the female housing, fitting force generated when a worker presses the female housing or the male housing in the fitting direction includes insertion force and climbing force. The insertion force is generated when the male terminal is inserted into the female terminal. The climbing force is generated when a member to be engaged climbs over an engagement projection part in the fitting direction. That is, depending on the shape of the engagement projection part and the member to be engaged, the fitting force is largely changed, and the feeling of fitting the male connector to the female connector is changed.

SUMMARY OF THE INVENTION

The present invention has been made in view of the above, and an object of the present invention is to provide a connector that can obtain a suitable feeling when a male connector is fitted to a female connector.

In order to solve the above mentioned problem and achieve the object, a connector according to one aspect of the present invention includes a first connector housing that includes an engagement projection part protruding from an outer peripheral surface and a separated projection part separated from the engagement projection part in a fitting direction; one or more first terminals housed inside the first connector housing; a second connector housing that is fitted to the first connector housing in the fitting direction, and that includes a engaged part that is engaged by the engagement projection part and is brought into an engaged state, by climbing over the engagement projection part in a fitting state, and entering between the engagement projection part and the separated projection part; one or more second terminals that are housed inside the second connector housing, and that are connected to the respective first terminals in the fitting state; and a fitting detection member that is movable from an initial position to a fitting assurance position in the engaged state by being supported by the second connector housing, and that includes a detection projection part sequentially climbing over the engagement projection part and the engaged part with movement from the initial position to the fitting assurance position, and facing the separated projection part at the fitting assurance position in the fitting direction, wherein the engaged part includes a climbing surface formed on an end part at a first direction side, out of both end parts in the fitting direction, and a tip end projection that protrudes in a first direction from an end part at an upper direction side, out of both end parts in a vertical direction orthogonal to the fitting direction of the climbing surface, and the engagement projection part includes a climbed surface that is formed on an end part at a second direction side, out of both end parts in the fitting direction, and that comes into contact with the climbing surface in the fitting direction, and after connection of the first terminal with the second terminal is started, the tip end projection faces the engagement projection part in the vertical direction, and after the tip end projection faces the engagement projection part, the climbing surface comes into contact with the climbed surface.

According to another aspect of the present invention, in the connector, it is preferable that in the engaged part, an upper surface out of both surfaces in the vertical direction is formed flat, and an end part at a first direction side extends to an end part at a first direction side of the tip end projection.

According to still another aspect of the present invention, in the connector, it is preferable that in the separated projection part, an upper surface out of both surfaces in the vertical direction is formed flat, and in the engaged state, the upper surface is formed in a straight line with the upper surface of the engaged part, or in a lower direction in the vertical direction than the upper surface of the engaged part.

According to still another aspect of the present invention, in the connector, it is preferable that in the engagement projection part, in the engaged state, an upper surface out of both surfaces in the vertical direction is formed at a lower direction side than the upper surface of the engaged part, in the engaged part, a guide surface that continues to the upper surface is formed on an end part at a second direction side, out of both end parts in the fitting direction, and when viewed from the fitting direction, the guide surface is an inclined surface that protrudes from the upper surface of the engagement projection part and that protrudes to the second direction side toward the upper direction.

According to still another aspect of the present invention, in the connector, it is preferable that the fitting detection member includes a main body part, and a lock arm part an end of which is linked to the main body part, and the detection projection part is formed on another end of the lock arm part, and the lock arm part protrudes in a lower direction from a lower surface out of both surfaces in the vertical direction, and is formed with a rib that continues to the detection projection part.

According to still another aspect of the present invention, in the connector, it is preferable that a gap is formed between the tip end projection and the engagement projection part, when the tip end projection and the engagement projection part face each other in the vertical direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment according to the present invention will be described in detail with reference to the accompanying drawings. It is to be understood that the present invention is not limited to the embodiment. Moreover, components in the following embodiment include components that can be easily replaced by a person skilled in the art, or components substantially the same as those components.

Embodiment

Figure 1:
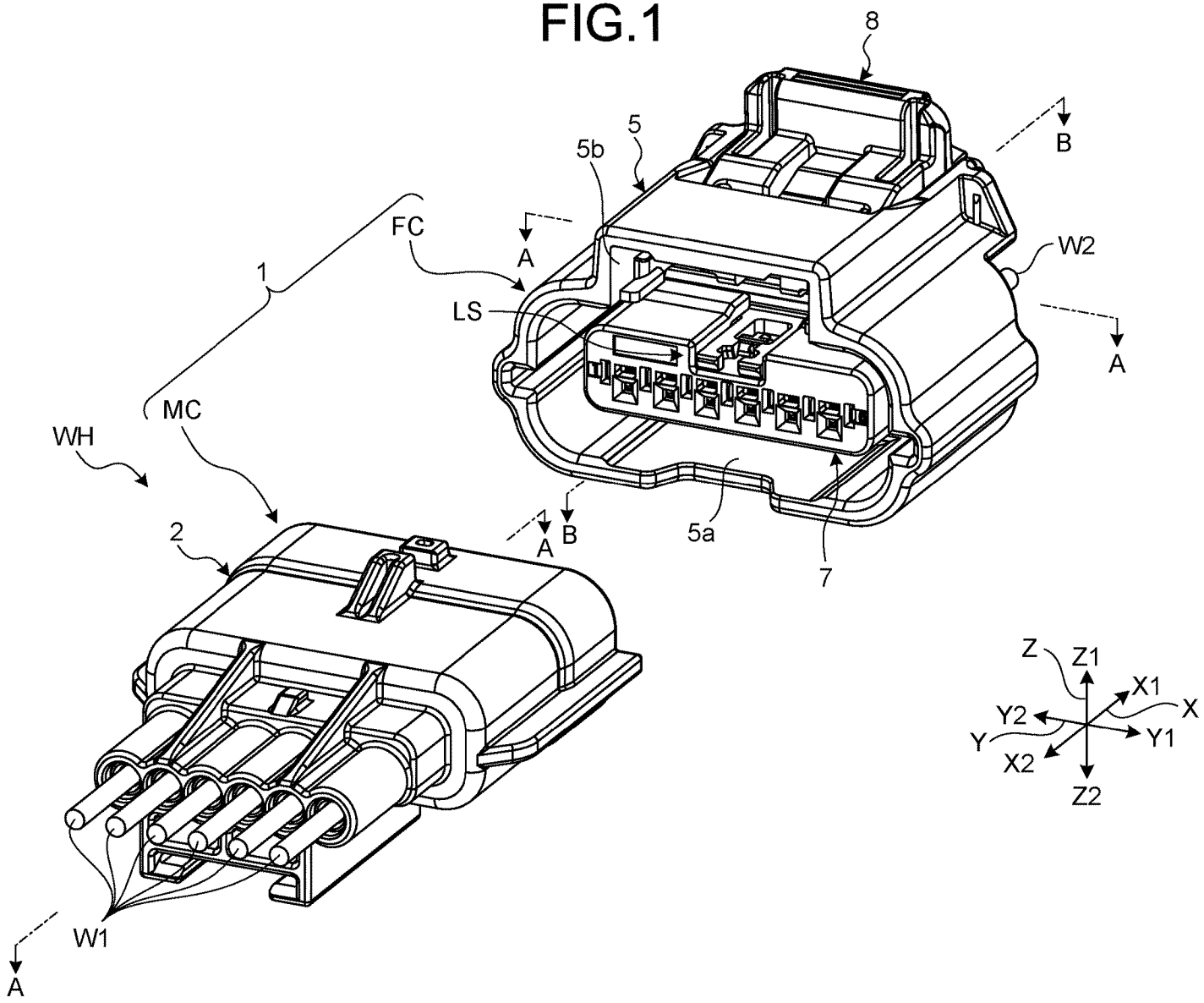
FIG. 1 is a perspective view illustrating a CPA connector in an embodiment.
Figure 2:
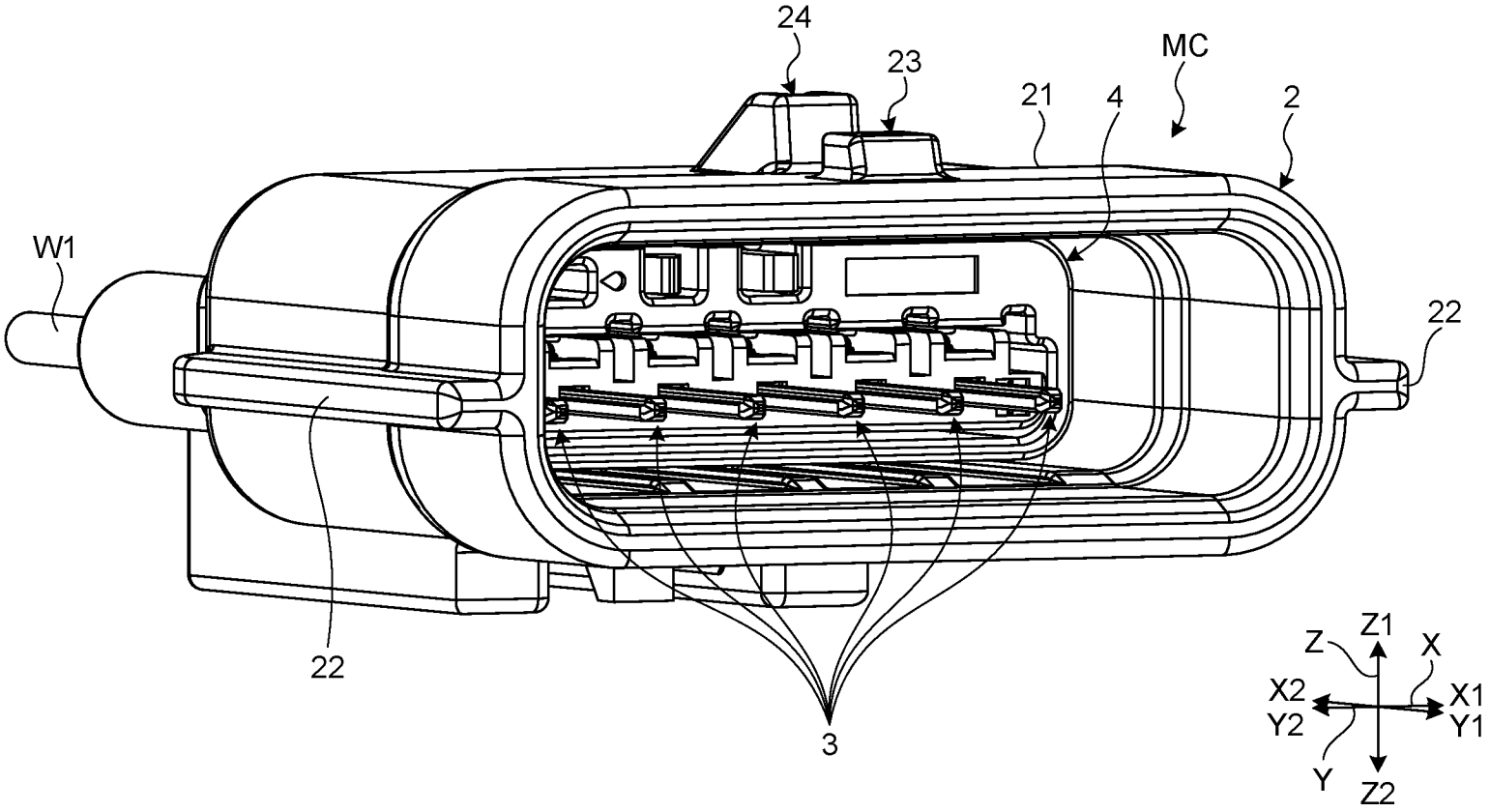
FIG. 2 is a perspective view illustrating a male connector in the embodiment.
Figure 3:
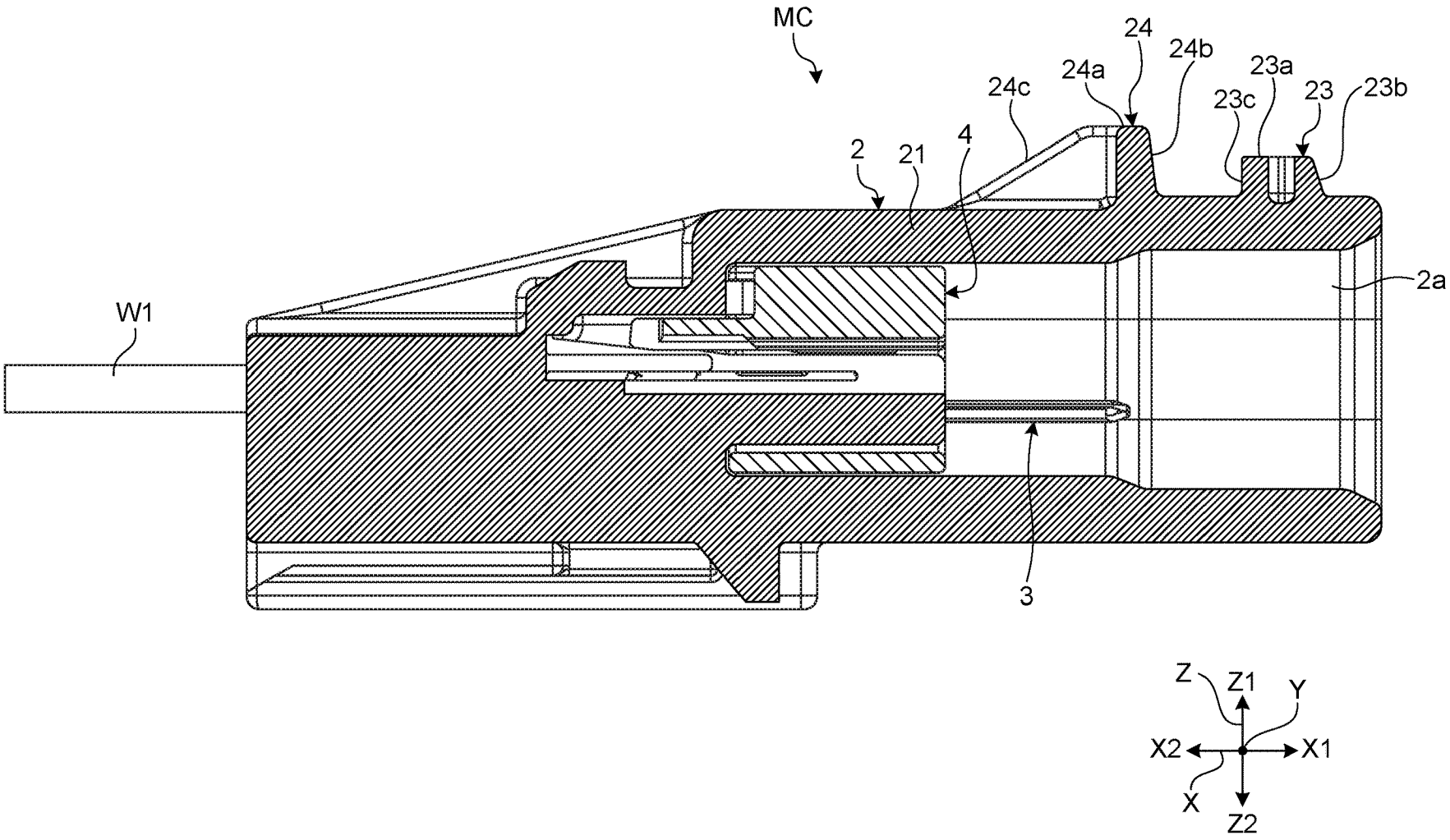
FIG. 3 is a sectional view illustrating the male connector in the embodiment.
Figure 4:
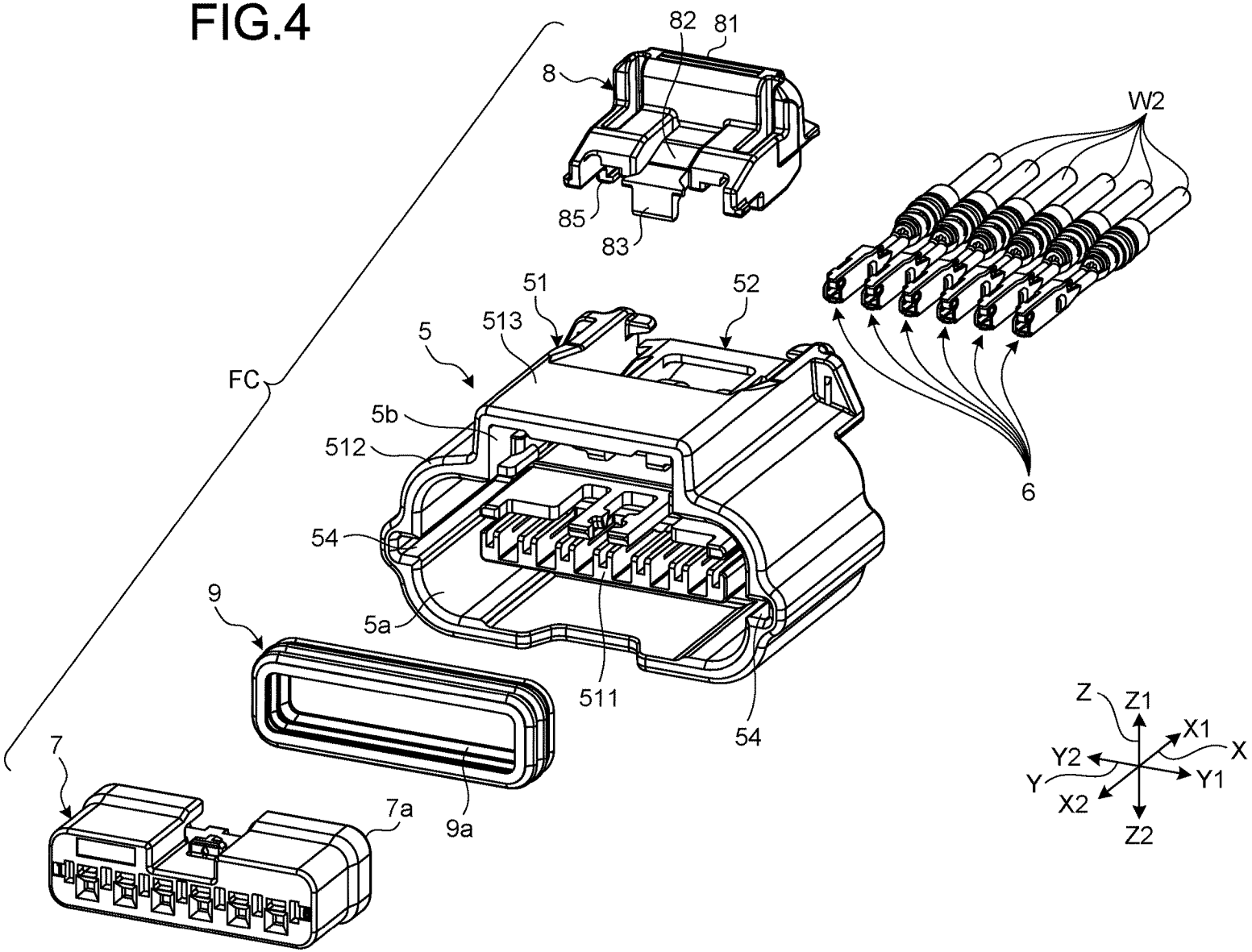
FIG. 4 is an exploded perspective view illustrating a female connector in the embodiment.
Figure 5:
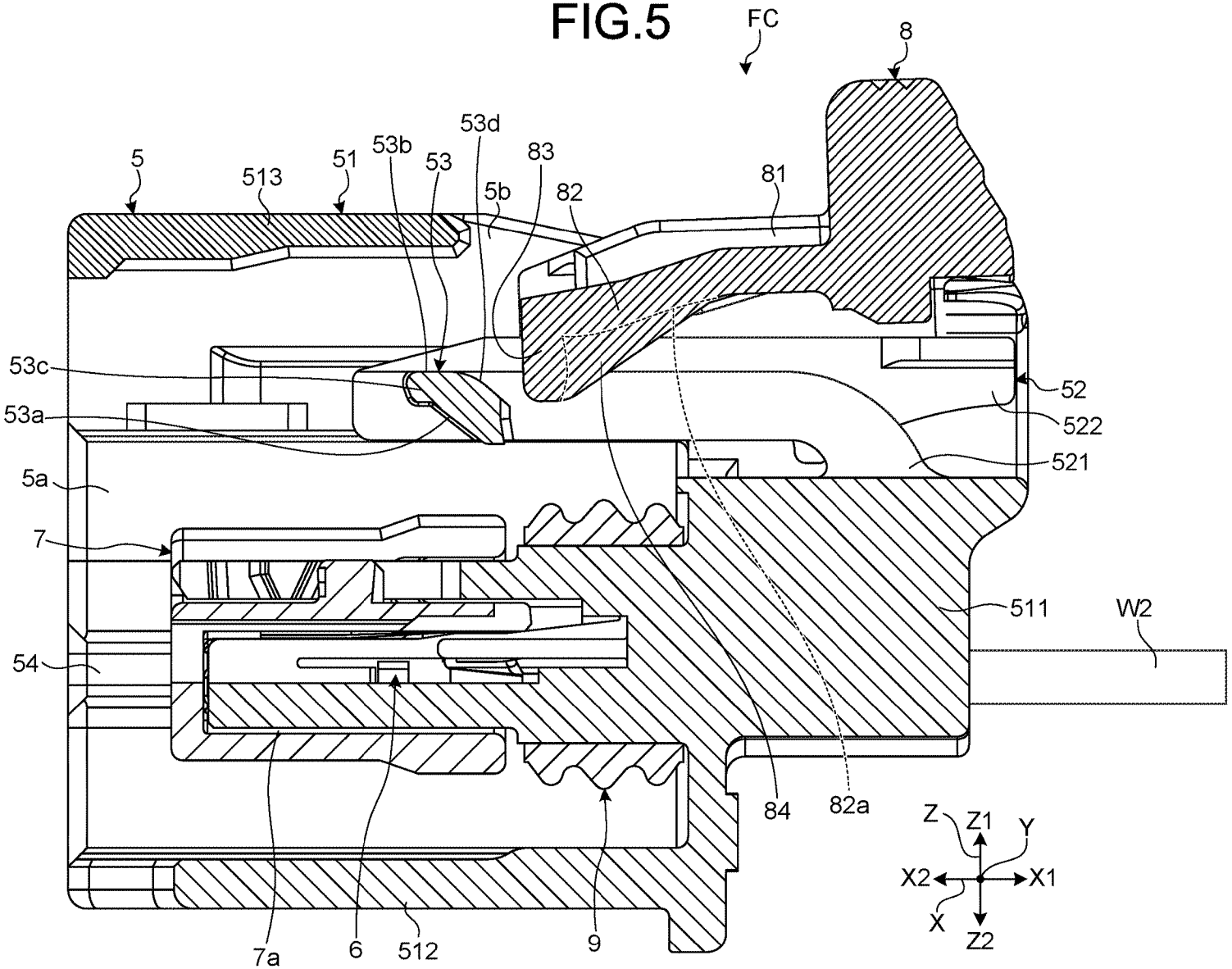
FIG. 5 is a sectional view of the female connector in the embodiment.
Figure 6:
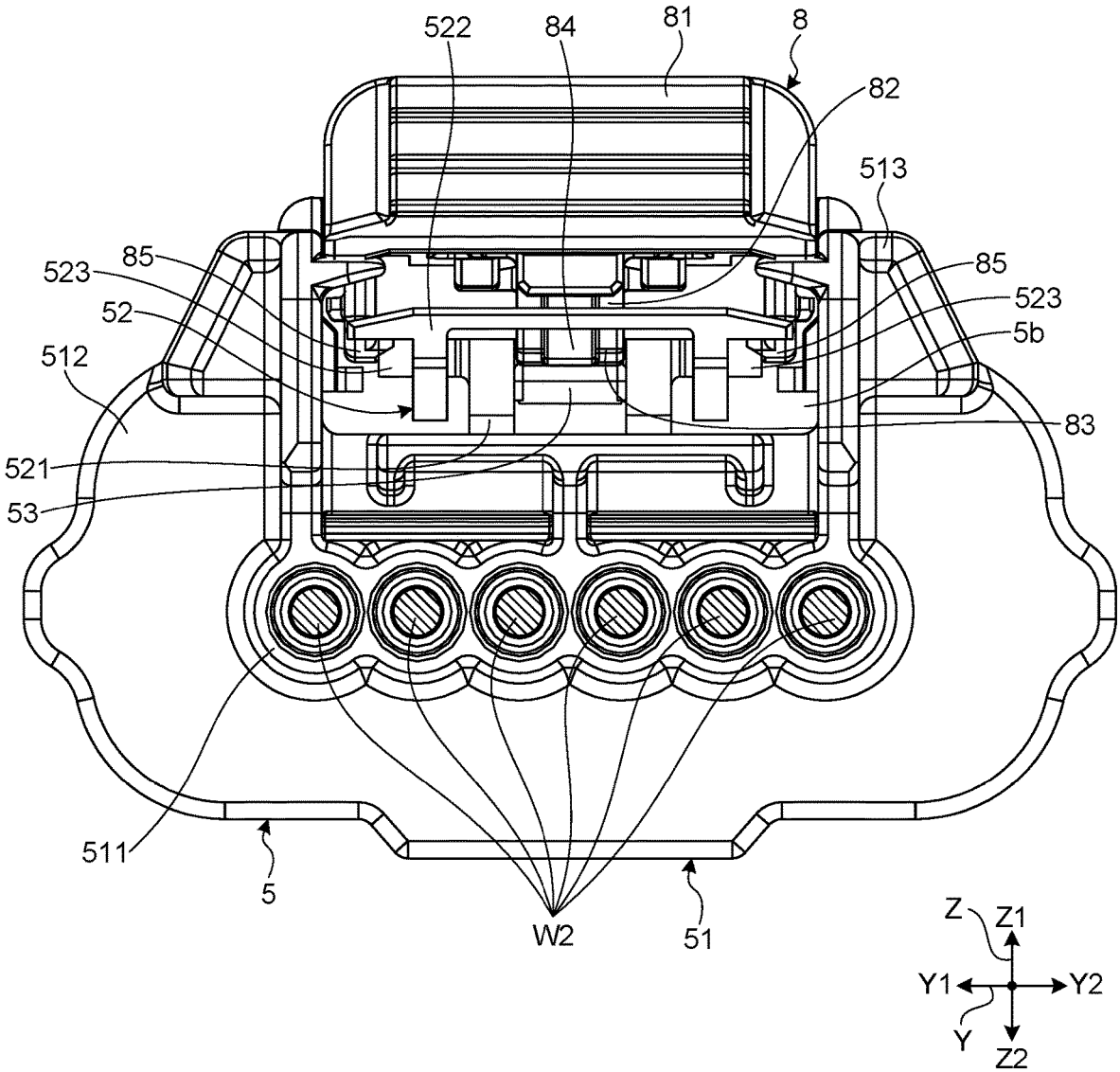
FIG. 6 is a rear view of the female connector in the embodiment.
Figure 7:
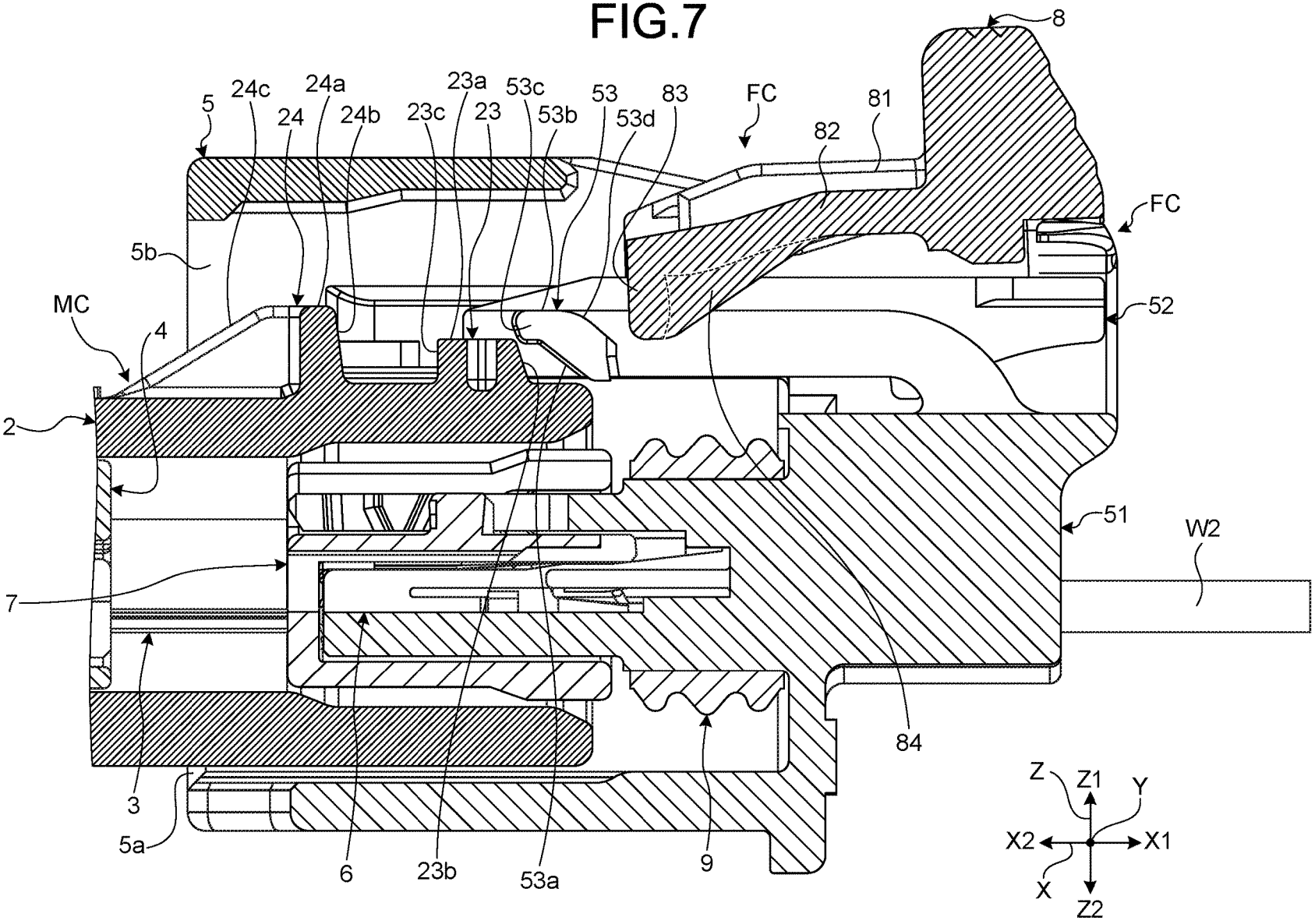
FIG. 7 is a diagram for explaining how the CPA connector is fitted (a state before being fitted) in the embodiment.
Figure 8:
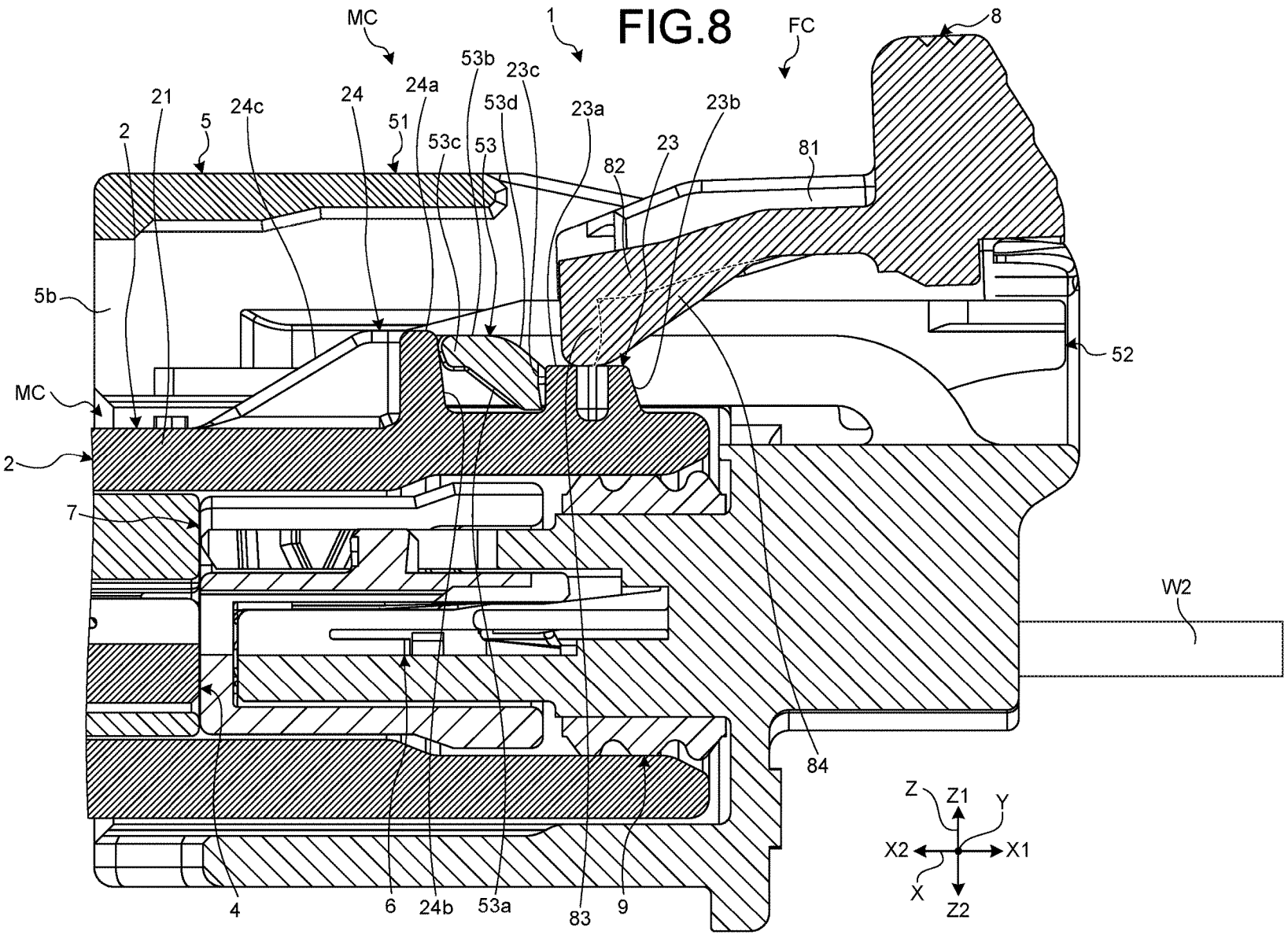
FIG. 8 is a diagram for explaining how the CPA connector is fitted (an engaged state) in the embodiment.
Figure 9:
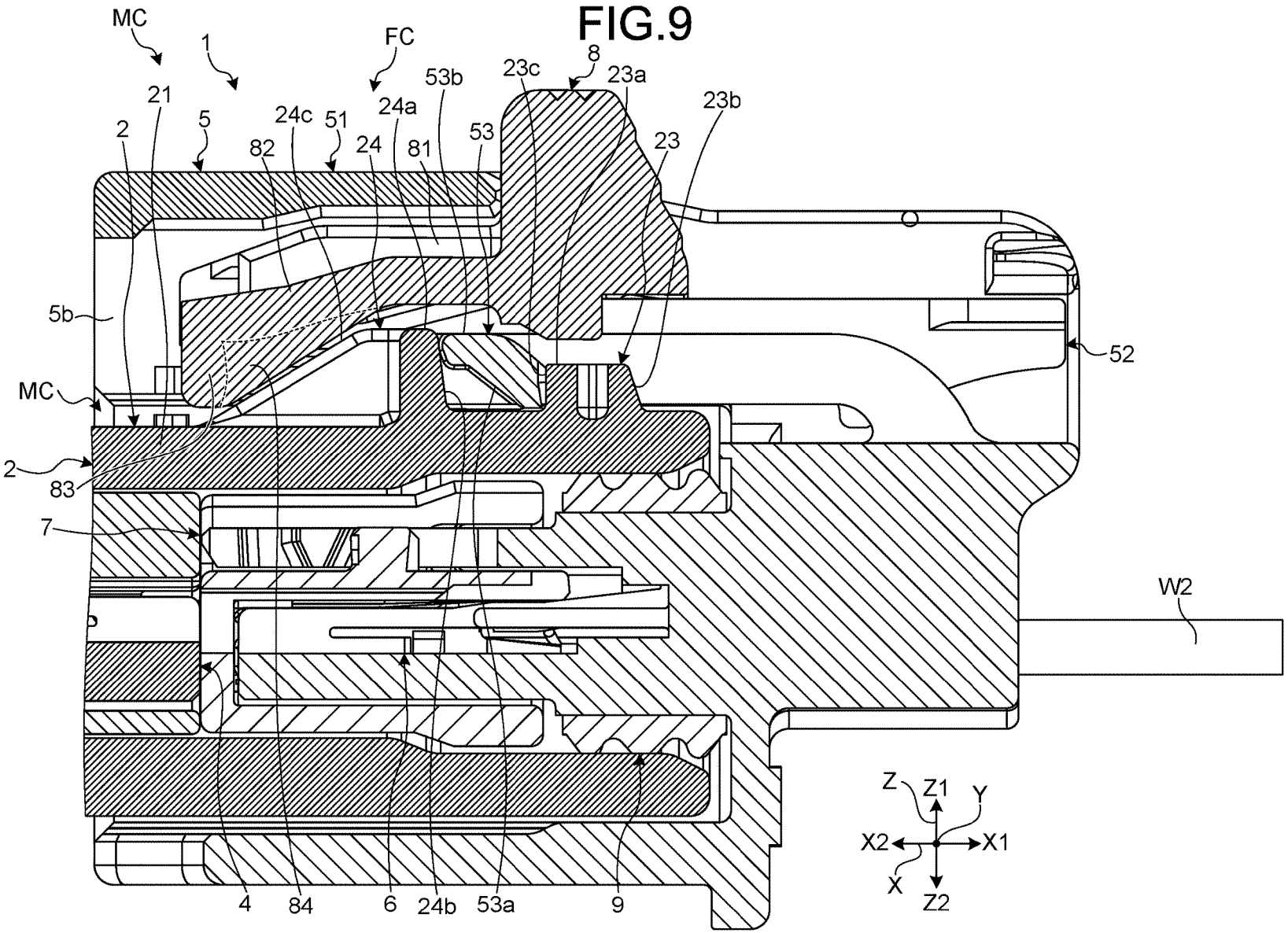
FIG. 9 is a diagram for explaining how the CPA connector is fitted (a state when the fitting is assured) in the embodiment.

FIG. 1 is a perspective view illustrating a connector position assurance (CPA) connector in an embodiment. FIG. 2 is a perspective view illustrating a male connector in the embodiment. FIG. 3 is a sectional view illustrating the male connector in the embodiment. FIG. 4 is an exploded perspective view illustrating a female connector in the embodiment. FIG. 5 is a sectional view of the female connector in the embodiment. FIG. 6 is a rear view of the female connector in the embodiment. FIG. 7 is a diagram for explaining how the CPA connector is fitted (a state before being fitted) in the embodiment. FIG. 8 is a diagram for explaining how the CPA connector is fitted (an engaged state) in the embodiment. FIG. 9 is a diagram for explaining how the CPA connector is fitted (a state when the fitting is assured) in the embodiment. It is to be noted that FIG. 1 illustrates a state when elements that configure the male connector and the female connector are being combined. FIG. 4 illustrates a state when elements that configure the female connector are being dismantled. Moreover, FIG. 3 is a sectional view cut along line A-A in FIG. 1, and FIG. 5 is a sectional view cut along line B-B in FIG. 1.

An X direction in FIG. 1 to FIG. 9 is a fitting direction of a CPA connector 1 in the present embodiment, and is a longitudinal direction of a male connector MC and a female connector FC. A Y direction is orthogonal to the fitting direction, and is a width direction of the CPA connector 1 in the present embodiment. A Z direction is orthogonal to the fitting direction and the width direction, and is a vertical direction of the CPA connector 1 in the present embodiment. An X1 direction is a second direction and an inserting direction. An X2 direction is a first direction and a removing direction. A Y1 direction is a left direction, and a Y2 direction is a right direction. A Z1 direction is an upper direction, and a Z2 direction is a lower direction. Unless otherwise specified, the directions used in the following description indicate directions when the units are assembled to one another.

For example, the CPA connector 1 of the present embodiment is a connector applied to a wire harness WH and the like used in an automobile and the like. In this example, as illustrated in FIG. 1, the CPA connector 1 is a connection mechanism for wire-to-wire connection that connects a wire W1 and a wire W2 configuring the wire harness WH. For example, the CPA connector 1 is used in an air bag circuit. In this example, for example, the wires W1 and W2 each include a conductive part (core line) formed by twisting a plurality of conductive metal strands, and an insulating coating part that covers the outside of the conductive part. The CPA connector 1 includes the male connector MC and the female connector FC. When the male connector MC and the female connector FC are joined by being fitted with each other, a male terminal 3 and a female terminal 6 respectively provided in the male connector MC and the female connector FC are electrically connected. Consequently, an electrically connected portion is formed between the male connector MC and the female connector FC. The wires W1 and W2 are respectively connected to the male terminal 3 and the female terminal 6. A waterproof member is interposed between each of the outer peripheries of the wires W1 and W2, and a terminal insertion chamber of a male housing 2 and a terminal insertion chamber of a female housing 5, which will be described below. Consequently, the waterproof property is secured.

The male connector MC is a first connector, and as illustrated in FIG. 1 to FIG. 3, is a male type connector connected to the end of the wire W1 that configures the wire harness WH. The male connector MC includes the male housing 2, the male terminal 3, and a front holder 4.

The male housing 2 is a first connector housing, a connector housing at the male side, and formed of an insulating synthetic resin material and the like. The male housing 2 houses the male terminal 3, and includes a main body part 21, a male side rib 22, a male beak 23, and a beak restriction part 24.

The main body part 21 is formed in a substantially longitudinal cylindrical shape in which the removing direction side is closed along the fitting direction, and in which a fitting space part 2*a* is formed. The fitting space part 2*a* is a space part that communicates with the outside through an opening formed on the end part at the inserting direction side of the main body part 21, and to which the female housing 5 of the female connector FC is fitted. The main body part 21 holds the male terminal 3 so that the tip end part (end part at the inserting direction side) of the male terminal 3 is exposed to the inside of the fitting space part 2*a*, via the front holder 4.

A male side rib 22 protrudes from the outer peripheral surface of the main body part 21, and extends in the fitting direction. In the present embodiment, a pair of the male side ribs 22 are formed at positions that face each other in the width direction on the outer peripheral surface of the main body part 21. The pair of male side ribs 22 are respectively inserted into a pair of support groove parts 54, which will be described below, of the female housing 5, when the male connector MC and the female connector FC are fitted to each other. The pair of male side ribs 22 support the female housing 5 with respect to the male housing 2.

The male beak 23 is an engagement projection part and protrudes from the outer peripheral surface of the main body part 21. On the surface at the upper direction side in the outer peripheral surface of the main body part 21, the male beak 23 in the present embodiment is formed on a substantially center part in the width direction, and near the end part at the inserting direction side in the fitting direction. When viewed from the width direction, in the male beak 23, out of surfaces that face each other in the fitting direction with an upper surface 23*a* out of both surfaces in the vertical direction interposed therebetween, a climbed surface 23*b* that is a surface at the inserting direction side is formed into an inclined surface that protrudes to the inserting direction side toward the lower direction. An engaging surface 23*c* that is a surface at the removing direction side is formed parallel (including substantially parallel) to the vertical direction. The upper surface 23*a* of the male beak 23 is formed flat, and in the present embodiment, the male beak 23 is formed parallel to the fitting direction. The male beak 23 engages a female beak 53, which will be described below, of the female housing 5 in the fitting direction, and restricts the movement of the female beak 53 to the inserting direction side in an engaged state. In this example, in the engaged state, which will be described below, the upper surface 23*a* of the male beak 23 is formed at the lower direction side in the vertical direction, than an upper surface 53*b* of the female beak 53.

The beak restriction part 24 is a separated projection part, and protrudes from the outer peripheral surface of the main body part 21. On the surface at the upper direction side in the outer peripheral surface of the main body part 21, the beak restriction part 24 is formed on a substantially center part in the width direction. The beak restriction part 24 faces the male beak 23 in the fitting direction, and is formed on the removing direction side than the male beak 23 while being separated from the male beak 23. When viewed from the width direction, in the beak restriction part 24, out of surfaces that face each other in the fitting direction with an upper surface 24*a* out of both surfaces in the vertical direction interposed therebetween, a raised surface 24*b* at the inserting direction side is formed parallel (including substantially parallel) to the vertical direction. Moreover, a contact surface 24*c* that is a surface at the removing direction side is formed into an inclined surface that protrudes to the removing direction side toward the lower direction. The upper surface 24*a* of the beak restriction part 24 is formed flat, and in the present embodiment, is in parallel with the fitting direction. In this example, in the engaged state, which will be described below, the upper surface 24*a* of the beak restriction part 24 is formed in a straight line with the upper surface 53*b* of the female beak 53. In the engaged state, the straight line also includes a boundary of the upper surface 24*a* and the raised surface 24*b*. For example, when the boundary of the upper surface 24*a* and the raised surface 24*b* is chamfered, the straight line also includes a case where the upper surface 53*b* is placed in the vertical direction between the end part at the raised surface 24*b* side and the upper surface 24*a*, in the chamfered part. Moreover, in the engaged state, the straight line includes a boundary of the upper surface 53*b* and an end surface of the female beak 53 in the removing direction. For example, when the boundary of the upper surface 53*b* and the end surface of the female beak 53 in the removing direction is chamfered, the straight line also includes a case where the upper surface 24*a* is placed in the vertical direction between an end part at the end surface side of the female beak 53 in the removing direction and the upper surface 53*b*, in the chamfered part.

The male terminal 3 is a first terminal, and is electrically connected to the female terminal 6 when being inserted into the female terminal 6. One or more of the male terminals 3 are housed inside the male housing 2, and in the present embodiment, a plurality of the male terminals 3 are arranged and housed in the width direction. Each of the male terminals 3 is a male-type terminal fitting for a connector. As illustrated in FIG. 1 and FIG. 3, the male terminal 3 is connected to the end of the wire W1, and the entire male terminal 3 is formed of conductive metal. The male terminal 3 extends along the fitting direction while being held by the male housing 2. The male terminal 3 faces the front holder 4 in the fitting direction, and the tip end part protrudes to the fitting space part 2*a* from the front holder 4. The wire W2 is connected to the end part at the opposite side (end part at the removing direction side). In this example, the terminal insertion chamber extends in the fitting direction, and the end part at the female direction side communicates with the fitting space part 2*a*. The terminal insertion chamber communicates with the outside through an opening formed on an end part at the male direction side of the main body part 21. The male terminal 3 is held by the male housing 2, while the tip end part is exposed to the inside of the fitting space part 2*a* via the front holder 4, by being inserted into the terminal insertion chamber along the fitting direction, from the opening that communicates with the terminal insertion chamber formed in the end part at the male direction side of the main body part 21; and by being engaged with a lance, which will not be described.

As illustrated in FIG. 2 and FIG. 3, the front holder 4 is fitted to the inserting direction side of the male housing 2. The front holder 4 is held by the male housing 2, by being inserted into the fitting space part 2*a* of the male housing 2, and by being engaged to the male housing 2 by an engagement structure, which will not be described. On the end part at the inserting direction side of the front holder 4, an opening is formed corresponding to each of the male terminals 3 that face each other in the fitting direction, and the tip end part of the male terminal 3 protrudes to the fitting space part 2*a* from the opening.

The female connector FC is a second connector, and as illustrated in FIG. 1 and FIG. 4 to FIG. 6, is a female type connector connected to the end of the wire W2 that configures the wire harness WH. The female connector FC includes a female housing 5, a female terminal 6, a front holder 7, a CPA member 8, and a waterproof packing 9.

The female housing 5 is a second connector housing, and is a connector housing at the female side. The female housing 5 is fitted to the male housing 2 in the fitting direction, and is formed of an insulating synthetic resin material and the like. The female housing 5 houses the female terminal 6 to which the male terminal 3 is connected. The female housing 5 can be fitted to the male housing 2, when the male housing 2 is inserted into a fitting space part 5*a*. The female housing 5 includes a main body part 51, a lock arm part 52, the female beak 53, and the support groove part 54.

The main body part 51 is formed in a substantially longitudinal cylindrical shape in which the inserting direction side is closed along the fitting direction. A part of the main body part 51 is inserted into the fitting space part 2*a* with the front holder 7. The main body part 51 is a portion fitted with the male housing 2, when a part of the male housing 2 is inserted. The fitting space part 5*a* and a CPA member moving space part 5*b* are formed inside the main body part 51. The main body part 51 includes a first main body part 511, a second main body part 512, and a third main body part 513.

When viewed from the fitting direction, the first main body part 511 is formed in a rectangular shape, and extends along the fitting direction. The first main body part 511 holds the female terminal 6 via the front holder 7. A terminal insertion chamber corresponding to the female terminal 6 is formed in the first main body part 511. The terminal insertion chamber is a space part that extends in the fitting direction, that communicates with the outside through openings formed on both end parts of the first main body part 511 in the fitting direction, and that is held when the female terminal 6 is inserted along the fitting direction. In the present embodiment, a plurality of the terminal insertion chambers are formed inside the first main body part 511 in the width direction, corresponding to the number of a plurality of the female terminals 6 provided in the female housing 5.

The second main body part 512 is formed in a substantially longitudinal cylindrical shape in which the inserting direction side is closed along the fitting direction. The fitting space part 5*a* is formed inside the second main body part 512. The fitting space part 5*a* is a space part that communicates with the outside through an opening formed on the end part at the removing direction side of the second main body part 512, and to which the male housing 2 of the male connector MC is fitted.

The third main body part 513 is formed in a rectangular shape in which an opening is formed at the lower direction side along the fitting direction. The third main body part 513 communicates with the outside through openings formed on both end parts in the fitting direction, and communicates with the outside by the opening formed at the upper direction side of the end part at the inserting direction side. The CPA member moving space part 5*b* is formed inside the third main body part 513. The CPA member moving space part 5*b* is a space part into which the CPA member 8 is inserted, and that movably supports the CPA member 8 in the fitting direction.

The lock arm part 52 supports the female beak 53 with respect to the main body part 51 in the vertical direction with a space therebetween. The lock arm part 52 includes a first arm part 521 and a second arm part 522. When viewed from the vertical direction, the first arm part 521 is formed in a U-shape in which the removing direction side is opened. Both end parts of the first arm part 521 at the inserting direction side are linked to the first main body part 511. The first arm part 521 supports the lock arm part 52 with respect to the main body part 51 in an elastically deformable manner. In the first arm part 521, the female beak 53 is formed on the center part of the end part at the removing direction side in the width direction. Consequently, the first arm part 521 movably supports the female beak 53 with respect to the first main body part 511 in the vertical direction, by elastically deforming in the vertical direction. When viewed from the vertical direction, the second arm part 522 is formed in a U-shape in which the removing direction side is opened. Both end parts (two end parts in the width direction) of the second arm part 522 at the removing direction side are linked to both end parts of the first arm part 521 at the removing direction side. Guide rail parts 523 and 523 are formed on both end parts of the second arm part 522 in the width direction so as to protrude to the outside. A pair of the guide rail parts 523 and 523 in the present embodiment are held by a hooking part 85, which will be described below, of the CPA member 8, during the insertion of the CPA member 8 in which the CPA member 8 is inserted into the female housing 5. By being interposed between the CPA member 8 and the hooking part 85, the pair of guide rail parts 523 and 523 support the movement of the CPA member 8 with respect to the female housing 5 in the fitting direction, while restricting the movement of the CPA member 8 with respect the female housing 5 in the upper direction.

The female beak 53 is a engaged part. In a fitting state in which the female housing 5 is fitted to the male housing 2 in the fitting direction, the female beak 53 climbs over the male beak 23 in the vertical direction, enters between the male beak 23 and the beak restriction part 24 in the fitting direction, and is engaged by the male beak 23 in the fitting direction. The female beak 53 is brought into the engaged state when the female beak 53 is engaged by the male beak 23 in the fitting direction. The female beak 53 in the present embodiment protrudes in the lower direction from the end part at the removing direction side of the lock arm part 52. When viewed from the width direction, in the female beak 53, out of both end parts in the fitting direction, a climbing surface 53*a* is formed on the end part at the removing direction side. Out of both surfaces in the vertical direction, the climbing surface 53*a* in the present embodiment faces the upper surface 53*b* in the vertical direction. The climbing surface 53*a* is formed into an inclined surface that is recessed to the inserting direction side toward the lower direction. In this example, the inclination of the climbing surface 53*a* in the present embodiment is gentle in the fitting direction (inclination angle is small) with respect to the climbed surface 23*b*. In the female beak 53, out of both end parts of the climbing surface 53*a* in the vertical direction, a tip end projection 53*c* that protrudes in the removing direction from the end part at the upper direction side is formed on the end part at the upper direction side. In the female beak 53, the upper surface 53*b* is formed flat, and the end part at the removing direction side extends to the end part at the removing direction side of the tip end projection 53*c*. That is, out of both surfaces in the vertical direction of the tip end projection 53*c*, the upper surface 53*b* forms the surface at the upper direction side. The upper surface 53*b* in the present embodiment is formed parallel to the fitting direction. That is, the upper surface 53*b* of the female beak 53 is formed in a straight line with the upper surface 24*a* of the beak restriction part 24. Consequently, the upper surface 53*b* of the female beak 53 is placed on the straight line in which the upper surface 24*a* of the beak restriction part 24 is extended in the fitting direction. In the female beak 53, out of both end parts in the fitting direction, a guide surface 53*d* that continues to the upper surface 53*b* is formed on the end part at the inserting direction side. When viewed from the fitting direction, the guide surface 53*d* protrudes from the upper surface 23*a* of the male beak 23, and is formed into an inclined surface that protrudes to the removing direction side toward the upper direction. In the guide surface 53*d*, the end part at the removing direction side continues to the end part at the inserting direction side of the upper surface 53*b*. In this example, when viewed from the width direction, it is preferable that a boundary between the upper surface 53*b* and the guide surface 53*d* is formed into a curved surface, in other words, is being chamfered.

In this example, the female beak 53 is formed so that the tip end projection 53*c* faces the male beak 23 in the vertical direction, after the male terminal 3 and the female terminal 6 are connected, in other words, after the insertion of the tip end part of the male terminal 3 into the insertion space part of the female terminal 6, which will be described below, is started. That is, the tip end projection 53*c* of the female beak 53 is formed so that the male beak 23 is placed at the lower direction side of the tip end projection 53*c* in the vertical direction, when the male terminal 3 and the female terminal 6 are connected. The female beak 53 in the present embodiment is formed so that a gap is formed between the tip end projection 53*c* and the male beak 23, when the tip end projection 53*c* and the male beak 23 correspond with each other in the vertical direction.

The support groove part 54 is formed along the extending direction in the fitting space part 5*a*, and a plurality of the support groove parts 54 are formed corresponding to each of the pair of male side ribs 22.

The female terminal 6 is a second terminal, and is electrically connected to the male terminal 3, when the male terminal 3 is inserted. One or more of the female terminals 6 are housed in the female housing 5, and in the present embodiment, a plurality of the female terminals 6 are arranged and housed in the width direction. The female terminal 6 is a female-type terminal fitting for a connector, and as illustrated in FIG. 4 and FIG. 5, the female terminal 6 is connected to the end of the wire W2, and the entire female terminal 6 is formed of conductive metal. The female terminal 6 extends along the fitting direction while being held by the female housing 5. The tip end part of the female terminal 6 faces the front holder 7 in the fitting direction, and the wire W2 is connected to the end part at a side opposite to the tip end part (end part at the inserting direction side). The female terminal 6 is held by the female housing 5 by being inserted into the terminal insertion chamber along the fitting direction from an opening formed on the end part at the inserting direction side of the first main body part 511, and by being engaged by a lance, which will not be described. An insertion space part is formed in the female terminal 6. The insertion space part is a space part that extends in the fitting direction, that communicates with the outside through the opening formed at the removing direction side of the female terminal 6, and that is held when the tip end part of the male terminal 3 is inserted along the fitting direction.

As illustrated in FIG. 1, FIG. 4, and FIG. 5, in the front holder 7, a part of the female housing 5 is inserted into an insertion space part 7*a*. The front holder 7 restricts the movement of the female terminal 6 in the removing direction. The front holder 7 is fitted to the end part at the removing direction side of the first main body part 511, and covers the first main body part 511 at the removing direction side.

The CPA member 8 is a member for detecting whether the male housing 2 and the female housing 5 are completely fitted with each other, and is a member for achieving what is called connector position assurance (CPA). The CPA member 8 is inserted into the CPA member moving space part 5*b* of the female housing 5, and is supported by the female housing 5 so as to be able to move relative to the female housing 5 in the fitting direction. In the engaged state, the CPA member 8 can move in the removing direction with respect to the female housing 5, from the initial position to the fitting assurance position. In this example, the initial position is a position at which the CPA member 8 is moved to the end part at the inserting direction side with respect to the female housing 5. In the present embodiment, the initial position is a state when the CPA member 8 is mounted on a convex part formed on the third main body part 513. Moreover, the fitting assurance position is a position at which the CPA member 8 is moved to the end part in the removing direction with respect to the female housing 5, and is a position at which a CPA lock part 83, which will be described below, faces the beak restriction part 24 in the fitting direction. The CPA member 8 is formed of an insulating synthetic resin material and the like, and includes a main body part 81, a lock arm part 82, the CPA lock part 83, a rib 84, and the hooking part 85.

When viewed from the vertical direction, the main body part 81 is formed in a U-shape in which the removing direction side is opened. In the main body part 81, the end part at the inserting direction side protrudes to the upper direction side. An operation surface is formed on the main body part 81.

The lock arm part 82 elastically deformably supports the CPA lock part 83 with respect to the main body part 81 in the vertical direction. The lock arm part 82 is a plate-shaped member, and out of both end parts in the fitting direction, the end part at the inserting direction side is elastically deformably linked to the main body part 81 in the vertical direction.

The CPA lock part 83 is a detection projection part, and with the movement of the CPA member 8 from the initial position to the fitting assurance position in the engaged state, the CPA lock part 83 sequentially climbs over the male beak 23 and the female beak 53, and faces the beak restriction part 24 at the fitting assurance position in the fitting direction. Out of both end parts of the lock arm part 82 in the fitting direction, the CPA lock part 83 is formed on the end part at the removing direction side. Out of both surfaces of the lock arm part 82 in the vertical direction, the CPA lock part 83 in the present embodiment protrudes to the lower direction side from the end part at the removing direction side of a lower surface 82*a*.

The rib 84 protrudes in the lower direction from the lower surface 82*a* of the lock arm part 82. The rib 84 continues to the CPA lock part 83. The rib 84 in the present embodiment protrudes in the lower direction from the center part in the width direction of the lower surface 82*a*. The end part at the removing direction side of the rib 84 is linked to the end part at the removing direction side of the CPA lock part 83. When viewed from the width direction, the surface at the lower direction side of the rib 84 is integrally formed with the surface at the lower direction side of the CPA lock part 83.

The hooking part 85 supports the CPA member 8 with respect to the female housing 5. The hooking part 85 is formed on each of both end parts of the main body part 81 in the width direction. In this example, both end parts of the main body part 81 in the width direction protrude in the lower direction. Out of both end parts of the main body part 81 in the width direction, the hooking part 85 protrudes toward the inside from each of the inside surfaces that face each other in the width direction.

As illustrated in FIG. 2, the waterproof packing 9 prevents liquid such as water from entering the fitting space part 2*a* from the outside, by being placed in a gap between the male housing 2 and the female housing 5 in the fitting state. The waterproof packing 9 is formed in a ring-shape, and the first main body part 511 of the female housing 5 is inserted into an insertion space part 9*a* formed inside the waterproof packing 9 along the fitting direction.

Next, an assembly of the CPA connector 1, in other words, the fitting of the CPA connector 1 will be described. An assembly of the male connector MC will be described. First, as illustrated in FIG. 2 and FIG. 3, a worker inserts the male terminal 3 to which the wire W1 is connected into each terminal insertion chamber, from the opening formed on the end part in the removing direction of the main body part 21. The worker then engages the inserted male terminal 3 with the lance, and holds the male terminal 3 inside the male housing 2. Consequently, the male terminal 3 is assembled to the male housing 2. Next, the worker inserts the front holder 4 into the fitting space part 2*a* from the end part at the inserting direction side of the male housing 2, and holds the front holder 4 in the main body part 21 inside the fitting space part 2*a*. Consequently, the front holder 4 is assembled to the male housing 2.

Next, an assembly of the female connector FC will be described. First, as illustrated in FIG. 4 and FIG. 5, the worker inserts each female terminal 6 to which the wire W2 is connected into each terminal insertion chamber, from the opening formed on the end part at the inserting direction side of the first main body part 511. The worker then engages the inserted female terminal 6 with the lance, and holds the female terminal 6 inside the female housing 5. Consequently, the female terminal 6 is assembled to the female housing 5. Next, the worker inserts the waterproof packing 9 into the fitting space part 5*a* from the end part at the removing direction side of the second main body part 512, inserts the first main body part 511 into the insertion space part 9*a*, and holds the waterproof packing 9 with the first main body part 511. Consequently, the waterproof packing 9 is assembled to the female housing 5. Next, the worker inserts the front holder 7 into the fitting space part 5*a* from the end part at the removing direction side of the second main body part 512, inserts the first main body part 511 into the insertion space part 7*a* from the end part at the inserting direction side of the front holder 7, and holds the front holder 7 in the main body part 51 inside the fitting space part 5*a*. Consequently, the front holder 7 is assembled to the male housing 2.

Next, the worker inserts the CPA member 8 into the CPA member moving space part 5*b* of the female housing 5, and assembles the CPA member 8 to the female housing 5. In this process, the CPA member 8 is assembled in a state in which a pair of the hooking parts 85 restrain the pair of guide rail parts 523 and 523 of the lock arm part 52, and the CPA member 8 is placed at the initial position.

Next, the worker assembles the male connector MC to the female connector FC. As illustrated in FIG. 7, in a state in which the CPA member 8 is at the initial position, the worker inserts the first main body part 511 of the female housing 5 into the fitting space part 2*a* of the male housing 2, and inserts the male housing 2 into the fitting space part 5*a* of the female housing 5. In this process, when the insertion of the male housing 2 into the female housing 5 in the inserting direction is started, the tip end part of the male terminal 3 that is housed in the male housing 2 is inserted into the insertion space part of the female terminal 6 that is housed in the female housing 5. Consequently, insertion force is first generated as the fitting force. Next, after the connection of the male terminal 3 with the female terminal 6 is started, the male beak 23 and the tip end projection 53*c* of the female beak 53 face each other in the vertical direction with a space therebetween. That is, even when the male beak 23 and the tip end projection 53*c* of the female beak 53 face each other in the vertical direction, the fitting force is only the insertion force. Consequently, the fitting force is solely the insertion force, until the climbing surface 53*a* of the female beak 53 comes into contact with the climbed surface 23*b*. Thus, until the mounting force is added after the insertion force is solely generated as the fitting force, it is possible to move the male beak 23 to the position that faces the tip end projection 53*c* in the vertical direction, while suppressing the male beak 23 from being caught. Consequently, it is possible to obtain a suitable feeling when the male connector MC is fitted to the female connector FC. Next, after the male beak 23 and the tip end projection 53*c* of the female beak 53 face each other in the vertical direction, the climbing surface 53*a* of the female beak 53 comes into contact with the climbed surface 23*b* of the male beak 23. In this example, the climbing surface 53*a* and the climbed surface 23*b* come into contact with each other in the present embodiment such that the end part at the upper direction side of the climbed surface 23*b*, in other words, the boundary between the climbed surface 23*b* and the upper surface 23*a* comes into contact with the climbing surface 53*a*. The female beak 53 is elastically deformed in the upper direction while the climbing surface 53*a* comes into contact with the climbed surface 23*b*, and is mounted on the upper surface 23*a* of the male beak 23. In this example, as the fitting force, the resultant force of the insertion force and the climbing force in the fitting direction of the female beak 53 climbing over the male beak 23, is generated. The female beak 53 moves on the upper surface 23*a* of the male beak 23 in the removing direction, and enters between the male beak 23 and the beak restriction part 24 by being elastically restored. Consequently, as illustrated in FIG. 8, the female beak 53 is placed between the male beak 23 and the beak restriction part 24, and is brought into the engaged state.

Next, in the engaged state, the worker moves the CPA member 8 with respect to the female housing 5 from the initial position in the removing direction, and moves the CPA member 8 to the fitting assurance position. At the initial position, the CPA lock part 83 of the CPA member 8 is brought into contact with the upper surface 23*a* of the male beak 23. The CPA member 8 moves on the upper surface 23*a* of the male beak 23 in the removing direction, and comes into contact with the CPA lock part 83 and the guide surface 53*d* of the female beak 53. When the CPA lock part 83 is moved in the removing direction while coming into contact with the guide surface 53*d*, the lock arm part 82 is elastically deformed in the upper direction, and mounts on the upper surface 53*b* of the female beak 53. Consequently, in a state in which the CPA member 8 is mounted on the male beak 23 at the initial position, the CPA member 8 can smoothly mount on the upper surface 53*b* of the female beak 53. The CPA connector 1 can obtain a further suitable feeling when the male connector MC is fitted to the female connector FC.

The CPA lock part 83 moves on the upper surface 53*b* of the female beak 53 in the removing direction, and moves over onto the upper surface 24*a* of the beak restriction part 24 from the upper surface 53*b*. In this process, the upper surface 24*a* of the beak restriction part 24 is formed flat, and is formed in a straight line with the upper surface 53*b* of the female beak 53. Consequently, it is possible to prevent a concave portion from being formed between the upper surface 24*a* and the upper surface 53*b*. Thus, it is possible to smoothly move over the CPA lock part 83 from the upper surface 53*b* to the upper surface 24*a*, in a state in which the CPA lock part 83 is suppressed from being caught. The CPA connector 1 can obtain a further suitable feeling when the male connector MC is fitted to the female connector FC.

The CPA lock part 83 moves on the upper surface 24*a* of the beak restriction part 24 in the removing direction, and comes into contact with the contact surface 24*c* from the upper surface 24*a*. As illustrated in FIG. 9, when the CPA member 8 moves to the fitting assurance position, the CPA lock part 83 faces the beak restriction part 24 in the fitting direction. Consequently, under the condition that the CPA member 8 is in the engaged state, the CPA member 8 moves from the initial position to the fitting assurance position. Thus, it is possible to detect the fitting between the female connector FC and the male connector MC, thereby assuring the fitting.

In this manner, with the CPA connector 1 of the present embodiment, after the connection of the male terminal 3 with the female terminal 6 is started, the tip end projection 53*c* of the female beak 53 faces the male beak 23 in the vertical direction. Then, after the tip end projection 53*c* faces the male beak 23, the climbing surface 53*a* of the female beak 53 comes into contact with the climbed surface 23*b*. Consequently, as the fitting force, the insertion force is first solely generated by the connection between the male terminal 3 and the female terminal 6, and the climbing force is then generated when the climbing surface 53*a* comes into contact with the climbed surface 23*b* and the female beak 53 climbs over the male beak 23. Thus, it is possible to delay the timing at which the fitting force reaches its peak, from the timing immediately after the fitting force is generated. Hence, the CPA connector 1 can improve the suitable feeling when the male connector MC is fitted to the female connector FC, for example, fit feeling that is an index indicating whether the worker can smoothly fit the male connector MC to the female connector FC. Moreover, when the climbing force, which is generated when the climbing surface 53*a* comes into contact with the climbed surface 23*b* and the female beak 53 climbs over the male beak 23, is generated before the insertion force, which is generated when the male terminal 3 and the female terminal 6 are connected, the fit feeling may be reduced due to the fluctuation of the fitting force generated between the peak of the climbing force and the peak of the insertion force. However, with the CPA connector 1 of the present embodiment, by taking into an account the shape of the female beak 53, it is possible to obtain a suitable feeling, by delaying the timing of the peak of the climbing force, providing a period when the climbing force and the insertion force are both generated, and freely adjusting the fit feeling.

Moreover, in the CPA connector 1 of the present embodiment, the upper surface 53*b* of the female beak 53 is formed flat, and the end part at the removing direction side extends to the end part in the removing direction of the tip end projection 53*c*. Consequently, out of both surfaces of the tip end projection 53*c* in the vertical direction, the upper surface 53*b* forms the surface at the upper direction side, and no step is formed on the tip end projection 53*c*. Thus, the CPA lock part 83 of the CPA member 8 that is mounted on the upper surface 53*b* of the female beak 53 can be moved smoothly to the end part at the removing direction side of the female beak 53, while the CPA lock part 83 is suppressed from being caught. The CPA connector 1 can obtain a further suitable feeling, when the male connector MC is fitted to the female connector FC.

Furthermore, in the CPA connector 1 of the present embodiment, the rib 84 that continues to the CPA lock part 83 is formed on the lock arm part 82. When the CPA member 8 moves from the initial position to the fitting assurance position, the lock arm part 82 is elastically deformed in the upper direction. Consequently, the CPA lock part 83 is rotated in the upper direction on the basis of the end part at the inserting direction side of the lock arm part 82. That is, when the CPA lock part 83 passes while coming into contact with the male beak 23, the female beak 53, and the beak restriction part 24, the surface of the end part at the inserting direction side out of both end parts in the inserting direction of the end part at the lower direction side of the CPA lock part 83 comes into contact with the upper surface 23*a*, the upper surface 53*b*, and the upper surface 24*a*. More particularly, a concave part is formed between the upper surface 53*b* and the upper surface 24*a*. Out of both end parts in the fitting direction of the end part at the lower direction side of the CPA lock part 83, when the surface of the end part at the inserting direction side only comes into contact, the CPA lock part 83 may be caught while moving from the upper surface 53*b* to the upper surface 24*a*. On the other hand, in the CPA member 8 of the present embodiment, the rib 84 that continues to the inserting direction side of the CPA lock part 83 is formed on the CPA lock part 83. Thus, in the surface of the end part at the lower direction side of the rib 84, the end part at the removing direction side can come into contact with the upper surface 23*a*, the upper surface 53*b*, and the upper surface 24*a*. Consequently, when the CPA lock part 83 moves from the upper surface 53*b* to the upper surface 24*a*, the CPA lock part 83 and the rib 84 can come into contact with the upper surface 53*b* and the upper surface 24*a*. Thus, the CPA lock part 83 of the CPA member 8 can smoothly move from the initial position to the fitting assurance position, while the CPA lock part 83 is suppressed from being caught. The CPA connector 1 can obtain a further suitable feeling, when the male connector MC is fitted to the female connector FC.

In the present embodiment, the inclination of the climbing surface 53*a* is gentle (inclination angle is small) with respect to the climbed surface 23*b* in the fitting direction. However, this is not limiting, and the inclination of the climbed surface 23*b* may be gentle (inclination angle is small) with respect to the climbing surface 53*a* in the fitting direction. In this case, the climbing surface 53*a* and the climbed surface 23*b* come into contact with each other such that the end part at the lower direction side in the climbing surface 53*a*, in other words, the boundary between the climbing surface 53*a* and the bottom surface of the female beak 53, and the climbed surface 23*b* come into contact with each other. Moreover, in the present embodiment, the climbing surface 53*a* of the female beak 53 and the climbed surface 23*b* of the male beak 23 are formed into inclined surfaces. However, only one of the surfaces may be formed into an inclined surface, and the other surface may not be an inclined surface but may be a surface parallel to the vertical direction, for example.

In the present embodiment, in the engaged state, the upper surface 24*a* and the upper surface 53*b* are formed in a straight line. However, this is not limiting, and the upper surface 53*b* may be formed at the lower direction side than the upper surface 24*a* in the vertical direction.

With the present embodiment, it is possible to obtain a suitable feeling when the male connector is fitted to the female connector.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector, comprising:

a first connector housing that includes an engagement projection part protruding from an outer peripheral surface and a separated projection part separated from the engagement projection part in a fitting direction;

one or more first terminals housed inside the first connector housing;

a second connector housing that is fitted to the first connector housing in the fitting direction, and that includes a engaged part that is engaged by the engagement projection part and is brought into an engaged state, by climbing over the engagement projection part in a fitting state, and entering between the engagement projection part and the separated projection part;

one or more second terminals that are housed inside the second connector housing, and that are connected to the respective first terminals in the fitting state; and a fitting detection member that is movable from an initial position to a fitting assurance position in the engaged state by being supported by the second connector housing, and that includes a detection projection part sequentially climbing over the engagement projection part and the engaged part with movement from the initial position to the fitting assurance position, and facing the separated projection part at the fitting assurance position in the fitting direction, wherein the engaged part includes a climbing surface formed on an end part at a first direction side, out of both end parts in the fitting direction, and a tip end projection that protrudes in a first direction from an end part at an upper direction side, out of both end parts in a vertical direction orthogonal to the fitting direction of the climbing surface, and the engagement projection part includes a climbed surface that is formed on an end part at a second direction side, out of both end parts in the fitting direction, and that comes into contact with the climbing surface in the fitting direction, and after connection of the first terminal with the second terminal is started, the tip end projection faces the engagement projection part in the vertical direction, and after the tip end projection faces the engagement projection part, the climbing surface comes into contact with the climbed surface.

2. The connector according to claim 1, wherein in the engaged part, an upper surface out of both surfaces in the vertical direction is formed flat, and an end part at a first direction side extends to an end part at a first direction side of the tip end projection.

3. The connector according to claim 2, wherein in the separated projection part, an upper surface out of both surfaces in the vertical direction is formed flat, and in the engaged state, the upper surface is formed in a straight line with the upper surface of the engaged part, or in a lower direction in the vertical direction than the upper surface of the engaged part.

4. The connector according to claim 2, wherein in the engagement projection part, in the engaged state, an upper surface out of both surfaces in the vertical direction is formed at a lower direction side than the upper surface of the engaged part, in the engaged part, a guide surface that continues to the upper surface is formed on an end part at a second direction side, out of both end parts in the fitting direction, and when viewed from the fitting direction, the guide surface is an inclined surface that protrudes from the upper surface of the engagement projection part and that protrudes to the second direction side toward the upper direction.

5. The connector according to claim 3, wherein in the engagement projection part, in the engaged state, an upper surface out of both surfaces in the vertical direction is formed at a lower direction side than the upper surface of the engaged part, in the engaged part, a guide surface that continues to the upper surface is formed on an end part at a second direction side, out of both end parts in the fitting direction, and when viewed from the fitting direction, the guide surface is an inclined surface that protrudes from the upper surface of the engagement projection part and that protrudes to the second direction side toward the upper direction.

6. The connector according to claim 1, wherein the fitting detection member includes a main body part, and a lock arm part an end of which is linked to the main body part, and the detection projection part is formed on another end of the lock arm part, and the lock arm part protrudes in a lower direction from a lower surface out of both surfaces in the vertical direction, and is formed with a rib that continues to the detection projection part.

7. The connector according to claim 2, wherein the fitting detection member includes a main body part, and a lock arm part an end of which is linked to the main body part, and the detection projection part is formed on another end of the lock arm part, and the lock arm part protrudes in a lower direction from a lower surface out of both surfaces in the vertical direction, and is formed with a rib that continues to the detection projection part.

8. The connector according to claim 3, wherein the fitting detection member includes a main body part, and a lock arm part an end of which is linked to the main body part, and the detection projection part is formed on another end of the lock arm part, and the lock arm part protrudes in a lower direction from a lower surface out of both surfaces in the vertical direction, and is formed with a rib that continues to the detection projection part.

9. The connector according to claim 4, wherein the fitting detection member includes a main body part, and a lock arm part an end of which is linked to the main body part, and the detection projection part is formed on another end of the lock arm part, and the lock arm part protrudes in a lower direction from a lower surface out of both surfaces in the vertical direction, and is formed with a rib that continues to the detection projection part.

10. The connector according to claim 1, wherein a gap is formed between the tip end projection and the engagement projection part, when the tip end projection and the engagement projection part face each other in the vertical direction.

11. The connector according to claim 2, wherein a gap is formed between the tip end projection and the engagement projection part, when the tip end projection and the engagement projection part face each other in the vertical direction.

12. The connector according to claim 3, wherein a gap is formed between the tip end projection and the engagement projection part, when the tip end projection and the engagement projection part face each other in the vertical direction.

13. The connector according to claim 4, wherein a gap is formed between the tip end projection and the engagement projection part, when the tip end projection and the engagement projection part face each other in the vertical direction.

14. The connector according to claim 6, wherein a gap is formed between the tip end projection and the engagement projection part, when the tip end projection and the engagement projection part face each other in the vertical direction.

* * * * *